US009583050B2

(12) United States Patent
Hsieh et al.

(10) Patent No.: US 9,583,050 B2
(45) Date of Patent: Feb. 28, 2017

(54) DISPLAY APPARATUS AND BACKLIGHT DRIVING MODULE

(71) Applicant: Fitipower Integrated Technology, Inc., Hsinchu (TW)

(72) Inventors: Chung-Hsiao Hsieh, Hsinchu (TW); Chung-Hao Chang, Hsinchu (TW)

(73) Assignee: Fitipower Integrated Technology, Inc., Hsinchu (TW)

( * ) Notice: Subject to any disclaimer, the term of this patent is extended or adjusted under 35 U.S.C. 154(b) by 16 days.

(21) Appl. No.: 14/690,931

(22) Filed: Apr. 20, 2015

(65) Prior Publication Data

US 2016/0210907 A1 Jul. 21, 2016

(30) Foreign Application Priority Data

Jan. 19, 2015 (TW) ..... 104101604 A

(51) Int. Cl.
*G09G 3/34* (2006.01)

(52) U.S. Cl.
CPC ..... *G09G 3/3406* (2013.01); *G09G 2320/064* (2013.01)

(58) Field of Classification Search
CPC ..... G09G 3/3406; G09G 2310/08; G09G 2320/0626
See application file for complete search history.

(56) References Cited

U.S. PATENT DOCUMENTS 5,844,540 A * 12/1998 Terasaki ..... G09G 3/3406 345/102
6,346,994 B1 * 2/2002 Inoue ..... G06T 5/009 358/1.9
2011/0069098 A1 * 3/2011 Lee ..... G09G 3/3225 345/691
2012/0306374 A1 * 12/2012 Lee ..... H05B 33/0896 315/121
2013/0021326 A1 1/2013 Tsai et al.

FOREIGN PATENT DOCUMENTS

TW I441140 6/2014

* cited by examiner

*Primary Examiner* — Ariel Balaoing
(74) *Attorney, Agent, or Firm* — Zhigang Ma

(57) ABSTRACT

A display apparatus includes a receiving module, a processing module, a selecting module, a power circuit, and a backlight module. The receiving module receives a pulse width modulating (PWM) signal from an external component. The processing module processes the PWM signal in a predetermined time duration. The selecting module outputs the unadjusted PWM signal to the power circuit in the predetermined time duration, and outputs an adjusted signal after the predetermined duration. The power circuit generates a first driving current for driving the backlight module to emit lights in response to the unadjusted PWM signal while the processing module processes the PWM signal. The backlight module remains a predetermined brightness after the predetermined time.

16 Claims, 4 Drawing Sheets

DISPLAY APPARATUS AND BACKLIGHT DRIVING MODULE

CROSS-REFERENCE TO RELATED APPLICATIONS

This application claims priority to Taiwanese Patent Application No. 104101604 filed on Jan. 19, 2015, the contents of which are incorporated by reference herein.

FIELD

The subject matter herein generally relates to a display apparatus and a backlight driving module.

BACKGROUND

A display apparatus includes a backlight module, a driving module, and a power circuit. The driving module receives an external pulse width modulating (PWM) signal and transmits the signal to the power circuit. The power circuit outputs a working current for driving the backlight module based on the PWM signal. The driving module calculates a working cycle of the PWM signal and adjusts the PWM signal to be in a high frequency range with the constant calculated working cycle of the PWM signal to avoid audio noise being generated in the driving process and for the backlight module to remain at a predetermined brightness. Based on the calculating process, the backlight module may be lit after a certain time.

BRIEF DESCRIPTION OF THE FIGURES

Implementations of the present technology will now be described, by way of example only, with reference to the attached figures.

DETAILED DESCRIPTION

Figure 1:
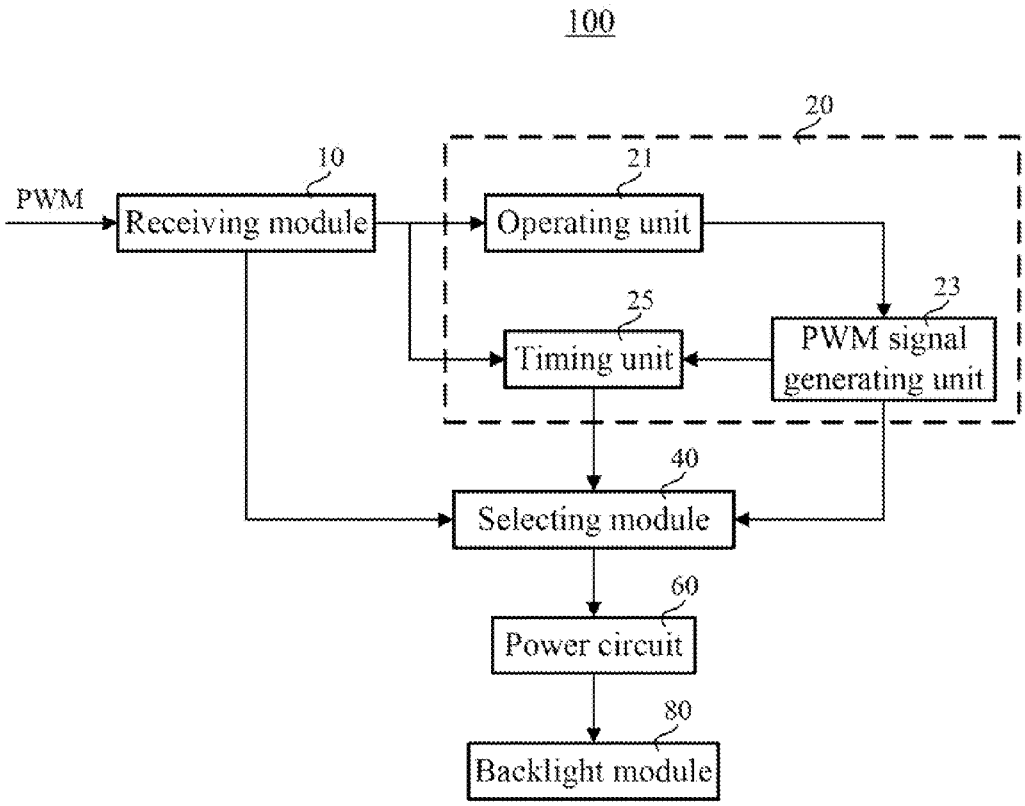
FIG. 1 is a block diagram view of an embodiment of a display apparatus.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

The term "comprising" means "including, but not necessarily limited to"; it specifically indicates open-ended inclusion or membership in a so-described combination, group, series and the like.

The present disclosure is described in relation to a display apparatus for preventing damage to a driving circuit.

FIG. 1 illustrates a display apparatus 100 for displaying images. The display apparatus 100 includes a receiving module 10, a processing module 20, a selecting module 40, a power circuit 60, and a backlight module 80.

The receiving module 10 receives a pulse width modulating (PWM) signal from an external component. In at least one embodiment, the PWM signal is combined by a first level signal and a second level signal in turn. The first level voltage is logic high voltage level and the second level voltage is logic low voltage level. A frequency of the PWM signal is between 100 Hz-20 kHz. The receiving module 10 receives the PWM signal from a sequence controlling chip.

The processing module 20 connects between the receiving module 10 and the selecting module 40. The processing module 20 can be configured to process the PWM signal in a predetermined time duration. The processing module 20 adjusts the PWM signal, and simultaneously outputs the adjusted signal and a selecting signal to the selecting module 40 after the predetermined time duration. The processing module 20 includes an operating unit 21, a PWM generating unit 23, and a timing unit 25.

The operating unit 21 connects the receiving module 10 and the PWM generating unit 23. The operating module 21 calculates a working cycle of the PWM signal in a first time duration, and outputs the calculated working cycle to the PWM generating unit 23.

The PWM generating unit 23 connects with the operating unit 21, the timing unit 25, and the selecting module 40. The PWM generating unit 23 outputs a timing signal to the timing unit 25 when receiving the calculated working cycle, and adjusts the PWM signal to form the adjusted signal with the calculated working cycle to the selecting module 40. In at least one embodiment, the adjusted signal is a PWM signal. A frequency of the adjusted signal is greater than the frequency of the PWM signal. In one example, and the frequency of the adjusted signal is beyond 20 kHz.

The timing unit 25 is connected to the receiving module 10, the PWM generating unit 23, and the selecting module 40. The timing unit 25 receives the PWM signal, and times a waiting duration in response to the timing signal output by the PWM generating unit 23. The timing unit 25 further generates a selecting signal to the selecting module 40 when the waiting duration exceeds a second time duration. The second time duration is a switching time of the first level signal of the received PWM signal from the receiving module 102 firstly switched into the second level signal when the timing signal is received. In at least one embodiment, the timing unit 25 is a counter.

The selecting module 40 connects with the receiving module 10, the timing unit 25, the PWM generating unit 23, and the power circuit 60. The selecting module 40 receives PWM signal from the receiving module 10, a selecting signal from the timing unit 25, and the adjusted signal from the PWM generating unit 23. When only receiving the PWM signal from the receiving module 10, the selecting module 40 outputs the unadjusted PWM signal to the power circuit 60. When simultaneously receiving the PWM signal from the receiving module 10, the adjusted signal from the PWM generating unit 23, and the selecting signal from the timing unit 25, the selecting module can be further configured to output the adjusted signal to the power circuit 60. In at least one embodiment, the predetermined time duration is a sum of the first time duration and the second time duration. The working cycle of the unadjusted PWM signal and the adjusted PWM signal are the same. The selecting module 40 is a multiplexer.

The power circuit 60 connects the selecting module 40 and the backlight module 80. The power circuit 60 outputs a first driving current based on the unadjusted PWM signal, and outputs a second driving current based on the adjusted signal. In at least one embodiment, the first driving current and the second driving current have a common working cycle.

The backlight module 80 connects with the power circuit 60. The backlight module 80 emits light with a predetermined brightness based on the first driving current or the second driving current.

The selecting module 40 outputs unadjusted PWM signal based upon input from the receiving module 10 to the power circuit 60 while the processing module 20 processing the PWM signal received from the receiving module 10. The power circuit 60 outputs a first driving signal based upon input from the selecting module 40 to the backlight module 80, thus the backlight module 80 emits lights while the processing module 20 processing the PWM signal received from the receiving module 10. Using the presented technology, the time of the backlight module 80 to be lighted is improved and the backlight module 80 remains at a constant brightness.

Figure 2:
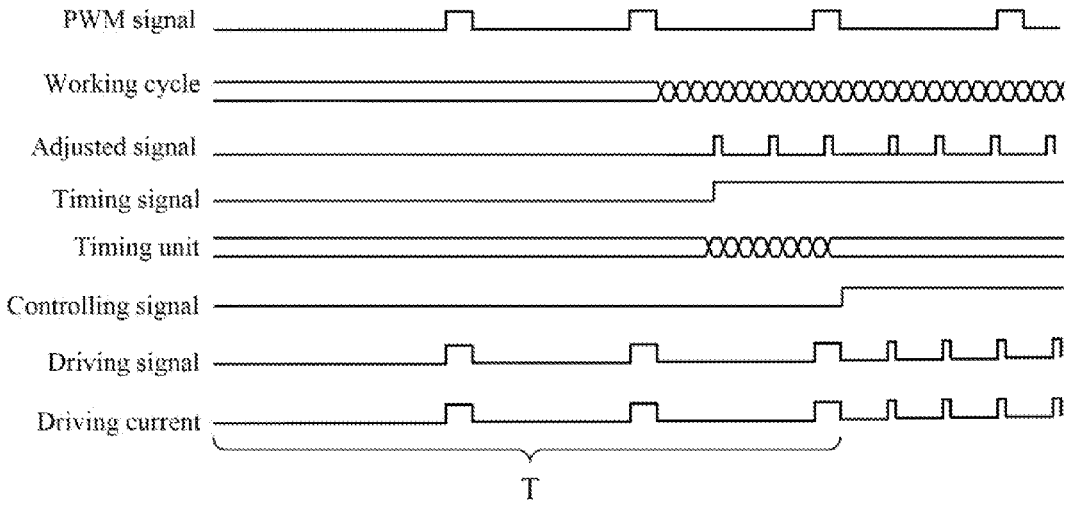
FIG. 2 is a diagram of waveforms of the display apparatus in operation of FIG. 1.

FIG. 2 illustrates waveforms of the display apparatus 100 in operation. The waveforms indicates the PWM signal received by the receiving module 10, the working cycle of the PWM signal, the adjusted signal generated by the PWM generating module 23, the timing signal generated by the operating unit 21, the working state of the timing unit 21, the selecting signal generated by the timing unit 25, the signal output by the selecting module 40, and the driving current output by the power circuit 60. T, as illustrated in FIG. 2, represents the predetermined time duration. During the predetermined time duration T, the waveform of the driving current synchronizes with the waveform of the adjusted signal and the waveform of the unadjusted PWM signal. After the predetermined time duration T, the waveform of the driving current synchronizes with the waveform of the adjusted signal. The working cycle of the PWM signal is equivalent to the working cycle of the adjusted signal.

Figure 3:
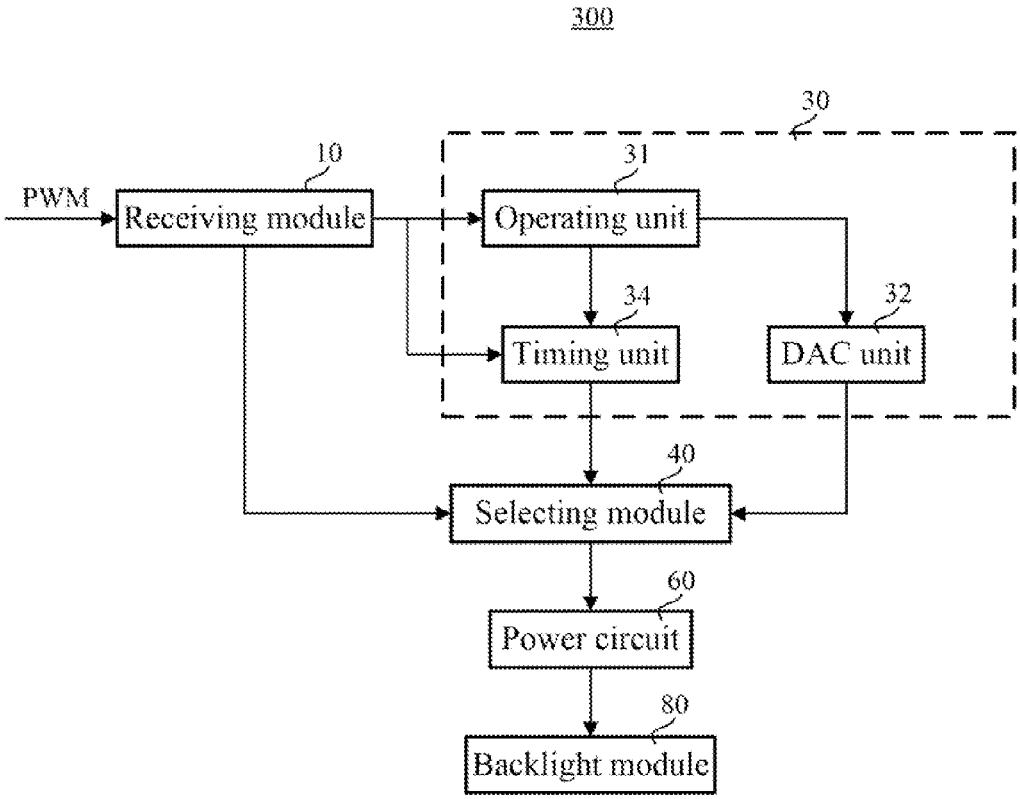
FIG. 3 is a block diagram view of a second embodiment of a display apparatus.

FIG. 3 illustrates a second embodiment of the display apparatus 300. The difference between the display apparatus 100 of FIG. 1 and the display apparatus 300 of FIG. 3 is the processing module 30. The processing module 30 includes an operating unit 31, a digital analog converter (DAC) unit 32, and a timing unit 34.

The operating unit 31 is connected to the receiving module 10, the DAC unit 32, and a timing unit 34. The operating module 31 calculates a working cycle of the PWM signal in a first time duration, and outputs a timing signal to the timing unit 34 after the first time duration.

The DAC unit 32 connects the operating unit 31 and the selecting module 40. The DAC unit 32 outputs an adjusted signal based on the calculated working cycle and the PWM signal to the selecting module 40. In at least one embodiment, the adjusted signal is an analog signal with a constant value.

The timing unit 34 connects with the receiving module 10, the operating unit 31, and the selecting module 40. The timing unit 34 times a waiting duration in response to the timing signals, and generates a selecting signal when the waiting duration exceeds a second time duration. The second time is a time of the first switching of the first level signal of the PWM signal to the second level signal while receiving the timing signal. In at least one embodiment, the timing unit 34 is a counter.

The selecting module 40 is connected to the receiving module 10, the timing unit 34, the DAC unit 32, and the power circuit 60. The selecting module 40 outputs the unadjusted PWM signal to the power circuit 60 in the predetermined time duration when there is no selecting signal received. After the predetermined time duration, the selecting module 40 simultaneously receives the PWM signal, the adjusted signal, and the selecting signal, and outputs the adjusted signal to the power circuit 60. In at least one embodiment, the predetermined time duration is a sum of the first time duration and the second time duration. The adjusted signal is constant value.

The power circuit 60 connects between the selecting module 40 and the backlight module 80. The power circuit 60 outputs a first driving current based on the unadjusted PWM signal, and outputs a second driving current based on the adjusted signal. In at least one embodiment, the first driving current is a PWM signal with a common working cycle, and the second driving current is a constant value.

The backlight module 80 connects with the power circuit 60. The backlight module 80 emits light with a predetermined brightness based on the first driving current or the second driving current.

Figure 4:
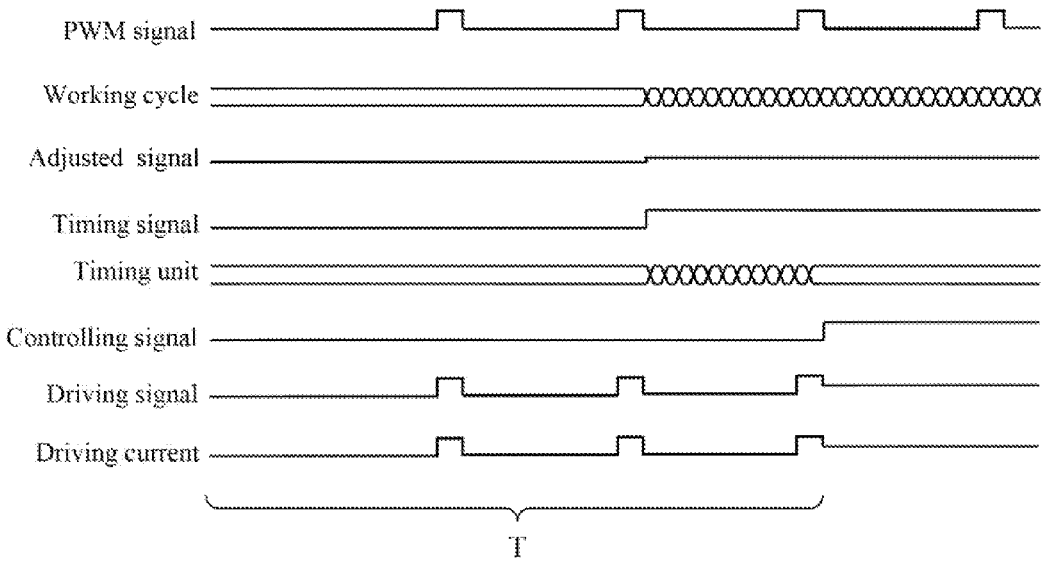
FIG. 4 is a diagram of waveforms of the display apparatus in operation of FIG. 3.

FIG. 4 illustrates waveforms of the display apparatus 300 in operation. The waveforms indicates the PWM signal received by the receiving module 10, the working cycle of the PWM signal, the analog signal generated by the DAC unit 32, the timing signal generated by the operating unit 31, the working state of the timing unit 31, the selecting signal generated by the timing unit 34, the signal output by the selecting module 40, and the driving current output by the power circuit 60. T, as illustrated in FIG. 4, represents the predetermined time duration. During the predetermined time duration T, the waveform of the driving current synchronizes with the waveform of the adjusted signal and the waveform of the PWM signal. After the predetermined time duration T, the waveform of the driving current synchronizes with the waveform of the analog signal.

The selecting module outputs unadjusted PWM signal based upon input from the receiving module to the power circuit while the processing module processing the PWM signal received from the receiving module. The power circuit outputs a first driving signal based upon input from the selecting module to the backlight module, thus the backlight module emits lights while the processing module processing the PWM signal received from the receiving module. Using the presented technology, the time of the backlight module to be lighted is improved and the backlight module remains at a constant brightness.

While various exemplary and preferred embodiments have been described, the disclosure is not limited thereto. On the contrary, various modifications and similar arrangements (as would be apparent to those skilled in the art) are intended to also be covered. Therefore, the scope of the appended claims should be accorded the broadest interpretation so as to encompass all such modifications and similar arrangements.

What is claimed is:

1. A display apparatus comprising:

a receiving module configured to receive a pulse width modulating (PWM) signal from an external component;

a processing module configured to process the PWM signal in a predetermined time duration;

a selecting module connected to the receiving module and the processing module, and the selecting module is configured to output, based upon different input signals from the receiving module and the processing module, different signals;

a power circuit electronically connected to the selecting module, and configured to generate a driving current, the generated driving current being based on the received signal from the selecting module; and a backlight module connected to the power circuit, and configured to emit lights based on the received driving current;

wherein the processing module comprises an operating unit, a PWM generating unit connected with the operating unit and the selecting module, and a timing unit connected with the PWM generating unit and the receiving module; the operating unit calculates a working cycle of the received PWM signal in a first time duration; the PWM unit generates a timing signal when receiving the calculated working cycle and adjusts the PWM signal to form a signal with the calculated working cycle; the timing unit times a duration of waiting in response to the timing signal, and generates a selecting signal when the duration of waiting exceeds a second time duration;

wherein the selecting module generates the unadjusted PWM signal to the power circuit in the predetermined time duration while the processing module processing the PWM signal, the power circuit generates a first driving current for driving the backlight module based on the unadjusted PWM signal.

2. The display apparatus of claim 1, wherein the processing module generates an adjusted signal and a selecting signal to the selecting module after the predetermined time duration; the selecting module outputs the adjusted signal when simultaneously receiving the unadjusted PWM signal, the adjusted signal, and the selecting signal, the power circuit generates a second driving current for driving the backlight module based on the adjusted signal.

3. The display apparatus of claim 2, wherein the predetermined time duration is a sum of the first time duration and the second time duration.

4. The display apparatus of claim 2, wherein the adjusted signal is a PWM signal, a frequency of the adjusted signal is greater than the frequency of the PWM signal, the frequency of the adjusted signal is beyond 20 kHz.

5. The display apparatus of claim 2, wherein the second time duration is a time of switching a logic high level signal of the PWM signal to a logic low level signal while receiving the timing signal.

6. The display apparatus of claim 2, wherein the processing module comprises an operating unit, a digital analog converter (DAC) unit connected with the operating unit and the selecting module, and a timing unit connected with the operating unit and the receiving module; the operating unit calculates a working cycle of the received PWM signal in a first time duration, and outputs a timing signal to the timing unit after the first time duration; the DAC unit outputs an adjusted signal based on the PWM signal and the calculated working cycle; the timing unit times a waiting duration in response to the timing signal, and generates a selecting signal when the waiting duration is exceeded a second time duration.

7. The display apparatus of claim 6, wherein the adjusted signal is an analogy signal with a constant value.

8. The display apparatus of claim 6, wherein the second time duration is a time of switching a logic high level signal of the PWM signal to a logic low level signal while receiving the timing signal.

9. A backlight driving module for driving a backlight module with a plurality of illumination units; the backlight driving module comprising:

a receiving module configured to receive a pulse width modulating (PWM) signal from an external component;

a processing module configured to process the PWM signal in a predetermined time duration;

a selecting module connected to the receiving module and the processing module, and the selecting module is configured to output, based upon different input signals form the receiving module and the processing module, different signals;

a power circuit electronically connected to the selecting module, and configured to generate a corresponding driving current, the value of the generated driving current being based on the received signal form the selecting module; and a backlight module connected to the power circuit, and configured to emit lights based on the received driving current;

wherein the processing module comprises an operating unit, a PWM generating unit connected with the operating unit and the selecting module, and a timing unit connected with the PWM generating unit and the receiving module; the operating unit calculates a working cycle of the received PWM signal in a first time duration; the PWM unit generates a timing signal when receiving the calculated working cycle and adjusts the PWM signal to form a signal with the calculated working cycle; the timing unit times a duration of waiting in response to the timing signal, and generates a selecting signal when the duration of waiting exceeds a second time duration;

wherein the selecting module generates the unadjusted PWM signal in the predetermined time duration; the backlight module emits lights while the processing module processes the PWM signal, and the backlight module remains a predetermined brightness after the predetermined time.

10. The backlight driving module of claim 9, wherein the processing module outputs an adjusted signal after the predetermined time duration; the selecting module outputs the adjusted signal when simultaneously receiving the PWM signal, the adjusted signal, and the selecting signal.

11. The backlight driving module of claim 10, wherein the predetermined time duration is a sum of the first time duration and the second time duration.

12. The backlight driving module of claim 10, wherein the adjusted signal is a PWM signal, a frequency of the adjusted signal is greater than the frequency of the PWM signal, the frequency of the adjusted signal is beyond 20 kHz.

13. The backlight driving module of claim 10, wherein the second time duration is a time of switching a logic high level signal of the PWM signal to a logic low level signal while receiving the timing signal.

14. The backlight driving module of claim 9, wherein the processing module comprises an operating unit, a digital analog converter (DAC) unit connected with the operating unit and the selecting module, and a timing unit connected with the operating unit and the receiving module; the operating unit calculates a working cycle of the received PWM signal in a first time duration, and outputs a timing signal to the timing unit after the first time duration; the DAC unit outputs the adjusted signal based on the PWM signal and the calculated working cycle; the timing unit times a waiting duration in response to the timing signal, and generates a selecting signal when the waiting duration is exceeded a second time duration.

15. The backlight driving module of claim 14, wherein the adjusted signal is an analogy signal with a constant value.

16. The backlight driving module of claim 14, wherein the second time duration is a time of switching a logic high level signal of the PWM signal to a logic low level signal while receiving the timing signal.

* * * * *